US005393057A

United States Patent [19]

Marnell, II

[11] Patent Number: 5,393,057

[45] Date of Patent: Feb. 28, 1995

[54] ELECTRONIC GAMING APPARATUS AND METHOD

[76] Inventor: Anthony A. Marnell, II, 3700 W. Flamingo Rd., Las Vegas, Nev. 89103

[21] Appl. No.: 832,709

[22] Filed: Feb. 7, 1992

[51] Int. Cl.[6] ..... G07F 17/34; A63F 9/24

[52] U.S. Cl. ..... 273/85 CP; 273/269

[58] Field of Search ..... 273/85 CP, 85 G, 138 R, 273/138 A, 143 R, 269, 237, 292

[56] References Cited

U.S. PATENT DOCUMENTS

| | | | |
|---|---|---|---|
| 1,723,377 | 8/1929 | Salomon . | |
| 3,534,963 | 10/1970 | Weimer . | |
| 4,364,567 | 12/1982 | Goott . | |
| 4,375,286 | 3/1983 | Seitz et al. | 273/138 A |
| 4,743,024 | 5/1988 | Helm et al. | 273/138 A |
| 4,756,531 | 7/1988 | DiRe et al. . | |
| 4,856,787 | 8/1989 | Itkis . | |
| 4,926,327 | 5/1990 | Sidley | 273/85 CP |
| 5,007,649 | 4/1991 | Richardson . | |
| 5,242,163 | 8/1993 | Fulton | 273/85 CP |

FOREIGN PATENT DOCUMENTS

| | | | |
|---|---|---|---|
| 0464935 | 1/1992 | European Pat. Off. | 273/169 |
| 2083936 | 3/1982 | United Kingdom | 273/138 A |
| 2137392 | 10/1984 | United Kingdom | 273/143 R |

*Primary Examiner*—Jessica J. Harrison

*Attorney, Agent, or Firm*—Quirk & Tratos

[57] ABSTRACT

An electronic gaming apparatus (21) including an electronic primary gaming device (22), such as a poker gaming device or slot machine and an electronic secondary gaming device (23). The electronic poker gaming device (22) is electrically coupled to the electronic secondary gaming device (23), and the primary gaming device (22) is responsive to the occurrence of selected events, such as poker hands or slot machine reel combinations, for input into the secondary gaming device (23). Thus, the occurrence of poker hands in the poker gaming device (22) produces selection of a space (52) in the bingo matrix (51) of a bingo-type gaming device (23). A plurality of poker gaming devices or slot machines ($21_1$–$21_{16}$) can be electrically coupled to a common bingo gaming device (23) for simultaneous play of a single bingo game by a plurality of players, each of whom is playing his or her own individual poker game.

33 Claims, 5 Drawing Sheets

ELECTRONIC GAMING APPARATUS AND METHOD

TECHNICAL FIELD

In general the present invention relates to an electronic gaming apparatus and method, and more particular, the invention relates to an electronic apparatus and method for playing games such as poker, slot machines and bingo.

BACKGROUND ART

In recent years numerous electronic gaming or game playing devices have been devised for playing gambling games, such as roulette, keno, poker, bingo, lotto and the like. Such electronic gaming apparatus conventionally is constructed in a general slot machine format and can include a number of different variations of these different games. Often such gaming apparatus includes a video game screen that is driven by an image generator coupled to a microprocessor, which acts as a controller. Similarly, reel-type slot machines have been microprocessor implemented so that the rotatable mechanical reels are now simulated by images on video display screens.

U.S. Pat. No. 4,856,787, for example, discloses an electronic game apparatus in which a plurality of players are linked electronically to a master game device and the individual players can concurrently play selected differing games. Thus, each player can select a game to play from a menu including games such as poker, bingo, keno, and blackjack, and all players are all monitored by the master game computer. The games being played, however, are not linked for play together, except that multiple players can elect to play the same bingo game in that the same drawn spaces can be input into multiple machines.

The play of a single game by a multiplicity of users is, however, well known. In U.S. Pat. Nos. 1,723,377 and 3,534,963 game apparatus are disclosed for the play of a poker game and a bingo game, respectively. Such apparatus is primarily non-electronic, but U.S. Pat. No. 5,007,649 discloses an electronic game apparatus in which there are a plurality of players playing a single game, such as bingo.

It is also known to provide electronic game apparatus in which there are multiple ways of winning a single game. Thus, in U.S. Pat. No. 4,756,513 players have up to three ways of winning a numbers game. The apparatus can be played by multiple machines connected together so that a plurality of players are able to play the same game.

Finally, U.S. Pat. No. 4,364,567 is typical of game apparatus which has been devised to combine different aspects of different games into a single game. In this case, various aspects of poker and keno have been combined together to create a new game.

It is also well known in casino electronic game apparatus to couple a plurality of gaming devices, such as slot machines or poker machines, together for payment of a progressive jackpot. The jackpot amount is continuously increased, usually in proportion to the number of games played at the various machines which are linked together during the time period in which there has been no jackpot. Such progressive jackpot gaming systems maintain and encourage continued play by the players by increasing the potential payout. There is, however, no strategy involved in connection with such progressive payout gaming apparatus, other than the strategy that continuing to play makes it more likely, with time, that someone will win the progressive jackpot.

Accordingly, it is an object of the present invention to provide a gaming apparatus and method in which the results of play of a primary game, such as draw poker or a reel-type slot machine, can be used to enable the play of a secondary game, such as bingo.

It is a further object of the present invention to provide an electronic gaming apparatus and method in which two games can be linked together, with the occurrence of events in one game being usable as an input to the other game.

Still a further object of the present invention is to provide an electronic gaming apparatus and method having a progressive payout in which a multiplicity of players can simultaneously play independent games and yet also can win the progressive payout by employing game-playing strategies in the play together of a progressive payout game.

It is a further object of the present invention to provide a gaming apparatus and method which is easy to operate by unsophisticated users, is adaptable to a number of different game combinations, has a minimum number of components, and is economical to manufacture.

The apparatus and method of the present invention have other objects and features of advantage which will become apparent from, and are set forth in more detail in, the description of the Best Mode of Carrying Out the Invention and the accompanying drawing.

SUMMARY OF INVENTION

The electronic gaming apparatus of the present invention comprises, briefly, an electronic primary gaming device, such as a poker gaming device or slot machine, having a display and input buttons for play of a primary game, such as a poker game; and electronic secondary gaming device, such as a bingo-type gaming device, including a display, such as a bingo matrix having a plurality of spaces. The poker gaming device and the bingo-type gaming device are electrically connected together. In one embodiment of the invention, the bingo matrix spaces are filled by a random generator device with indicia related to the primary gaming device. When predetermined results occur in the primary game, such as a poker hand or slot machine set of reels, these results are automatically entered in the secondary game. In another embodiment, user-actuatable space selection assembly, usually buttons, for the selection of spaces in the bingo matrix for input into the bingo game are provided. Upon the occurrence of selected poker hands, the poker gaming device activates the user-actuatable space selection assembly for input to the bingo-type gaming device. The input to the bingo-type gaming device is made to a space in the bingo matrix selected by the user using the user-actuatable space selection assembly, and the input preferably corresponds in value to the value of the poker hand which has occurred in the poker gaming device.

A plurality of electronic gaming apparatus of the type described preferably are electrically connected to a single bingo-type gaming device for simultaneous play of the bingo game by a plurality of individual players, which each are playing their own independent poker game.

The method of playing an electronic game of the present invention includes, briefly, the steps of playing a primary game, such as a poker game or slot machine game, on an electronic primary gaming device by conventional user input; and upon the occurrence of selected events, such as poker hands or sets of slot machine reels, playing a secondary game, such as a bingo type of game, on a secondary electronic gaming device electrically connected to the primary gaming device.

BEST MODE OF CARRYING OUT THE INVENTION

The electronic gaming apparatus of the present invention in its preferred form is comprised of a conventional electronic poker gaming device or a conventional reel-type slot machine which is electronically linked to an electronic bingo playing device in a manner enabling play of the bingo gaming device only upon the occurrence of winning hands in the poker gaming device or winning reel combinations in the slot machine. Most preferably a plurality of such electronic primary gaming devices are electronically linked to a single electronic bingo gaming device so that each player can play independent poker or slot machine games and play against each other in a common bingo game.

Figure 1:
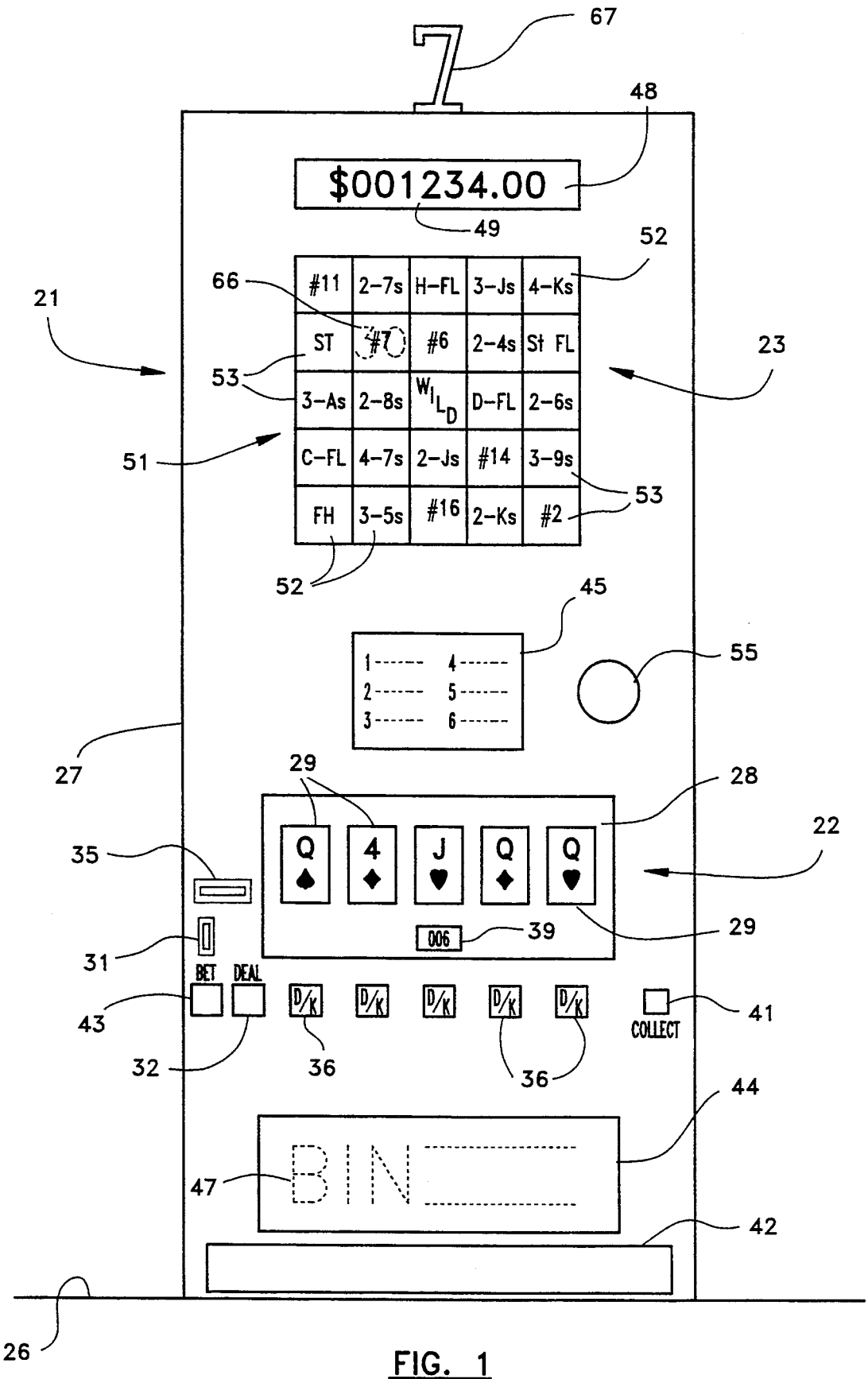
FIG. 1 is a front elevation view of a schematic representation of an electronic gaming apparatus constructed in accordance with the present invention for the play of a poker game that is coupled to a bingo game.

As can be seen in FIG. 1, the electronic gaming apparatus of the present invention, generally designated 21, includes a primary gaming device, such as an electronic poker gaming device, generally designated 22, that is electrically coupled to a secondary gaming device, such as an electronic bingo-type gaming device, generally designated 23.

In the gaming apparatus of the present invention, the primary gaming device preferably is a poker gaming device 22, but it will be appreciated that other primary gaming devices can be employed in the apparatus of the present invention. Thus, in FIG. 2 the primary gaming device **22*a* is a reel-type slot machine gaming apparatus, which is coupled to a bingo gaming apparatus 23*a*. Alternatively, primary gaming device 22** could be a dice game or a trivia quiz game. As will be apparent from the description below, games which have a plurality of events which occur and can be given different values, such as poker hands in a poker game, combinations of reels in a slot machine game or die combinations in a dice game, are particularly well suited for use as the primary gaming device.

Using the example of an electronic poker gaming device, such gaming apparatus can be constructed in a manner which is well known in the art. Accordingly, poker gaming apparatus 22 will only be described briefly herein. Additionally, poker gaming apparatus 22 will be described in terms of a conventional "draw poker" gaming apparatus, but it will be understood that other forms of poker and can be played on the primary or poker gaming apparatus 22.

Game apparatus 21 preferably is in a general format of a slot machine, for example, a machine of the type that is typically placed on a support counter 26 for play by a player while standing or seated on a stool. It will be understood, however, that bar-top versions or formats can also be employed. Mounted in game apparatus housing 27 is a conventional poker display screen, usually a video screen 28 upon which card images 29 can be displayed. A coin slot or token 31 is used to place bets, and once the desired number of coins or tokens have been inserted, "deal" button 32 can be pushed by the player to cause five card images 29 to appear on poker video display screen 28. The images which occur are selected by microprocessor or C.P.U., which drives a card image generator that is coupled to screen 28 in a manner described in more detail in connection with FIG. 4. Five card representations are randomly generated and graphically depicted or electronically displayed on screen 28 from a deck of fifty-two cards, or more, if wild cards are included.

Once a hand has been dealt to the player, the player can elect to discard or keep each of the cards. Most typically, five discard/keep or "D/K" buttons 36 are provided on the game apparatus for user actuation to effect either discard or keeping of each of cards 29. Depending upon the logic, pushing a switch 36 will discard a card and not pushing it will keep it. If a card is erroneously discarded, however, a second closing of switch 36 by pushing the switch button will restore the discarded card.

Once the player has made a decision with respect to discarding and keeping all of cards 29, it can again push "deal" button 32 and the microprocessor will replace the discarded cards with new cards randomly selected from the remainder of the deck. This completes the hand which is now compared by C.P.U. 33 with poker hand criteria stored in the C.P.U. memory. If the dealt hand matches any of the winning hands in memory, the player will receive an award, usually a number of coins or tokens of the type inserted in coin slot 31, depending upon the value of the hand stored in the microprocessor. Most typically, the number of coins will be visually indicated, for example, on video screen 28 at window 39, and the player will have the option of being able to collect the coins by pushing "collect" button 41, which releases coins or tokens into coin tray 42, or pushing "bet" button 43 to bet on a new hand.

Finally, electronic poker gaming device 22 may include a credit card reader 35 for betting without using coins, a speaker 55 for audio output associated with game play, a game rules panel 45 with brief rules and information thereon, and a "belly glass" panel 44 which can contain graphics, such as the name 47 of the game.

Figure 5:
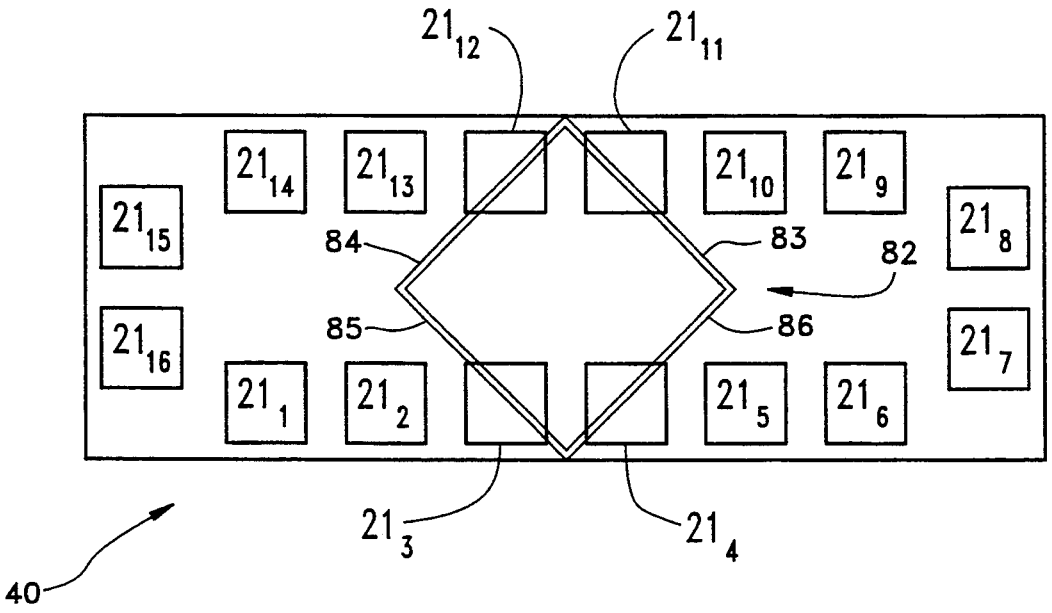
FIG. 5 is a top plan schematic representation of a plurality of electronic gaming apparatus of the type illustrated in FIGS. 1–3 electrically connected together for play by a plurality of players.

As also is known, electronic poker gaming apparatus can be coupled together with a plurality of machines in a common carousel so that a plurality of players can try to win a progressive jackpot. As seen in FIG. 5, therefore, poker machines $\mathbf{21}_1$–$\mathbf{21}_{16}$ are coupled together at a carousel, generally designated 40, to permit a progressive jackpot to be incremented as a function of, or in proportion to, the coin-in to the machines $21_1$–$21_{16}$ As seen in FIG. 1, therefore, a display window 48 shows the current value 49 of a progressive jackpot. Again, this is conventional electronic poker gaming apparatus technology and does not, per se, form a novel portion of the gaming apparatus of the present invention.

In order to provide a new dimension in game strategy and greatly enhanced entertainment value of a progressive jackpot, game apparatus 21 of the present invention includes a secondary or electronic gaming device, such as electronic bingo-type gaming device 23, which is linked electrically to the primary or poker gaming device 22. This linking together of a dependent or secondary gaming device to a primary gaming apparatus can be employed in a stand-alone gaming apparatus 21, but most preferably it is employed when a plurality of similarly formed gaming apparatus $21_1$–$21_{16}$ are linked together so that multiple players can play their individual poker games and at the same time play against each other in a common secondary or bingo-type game.

Figure 3:
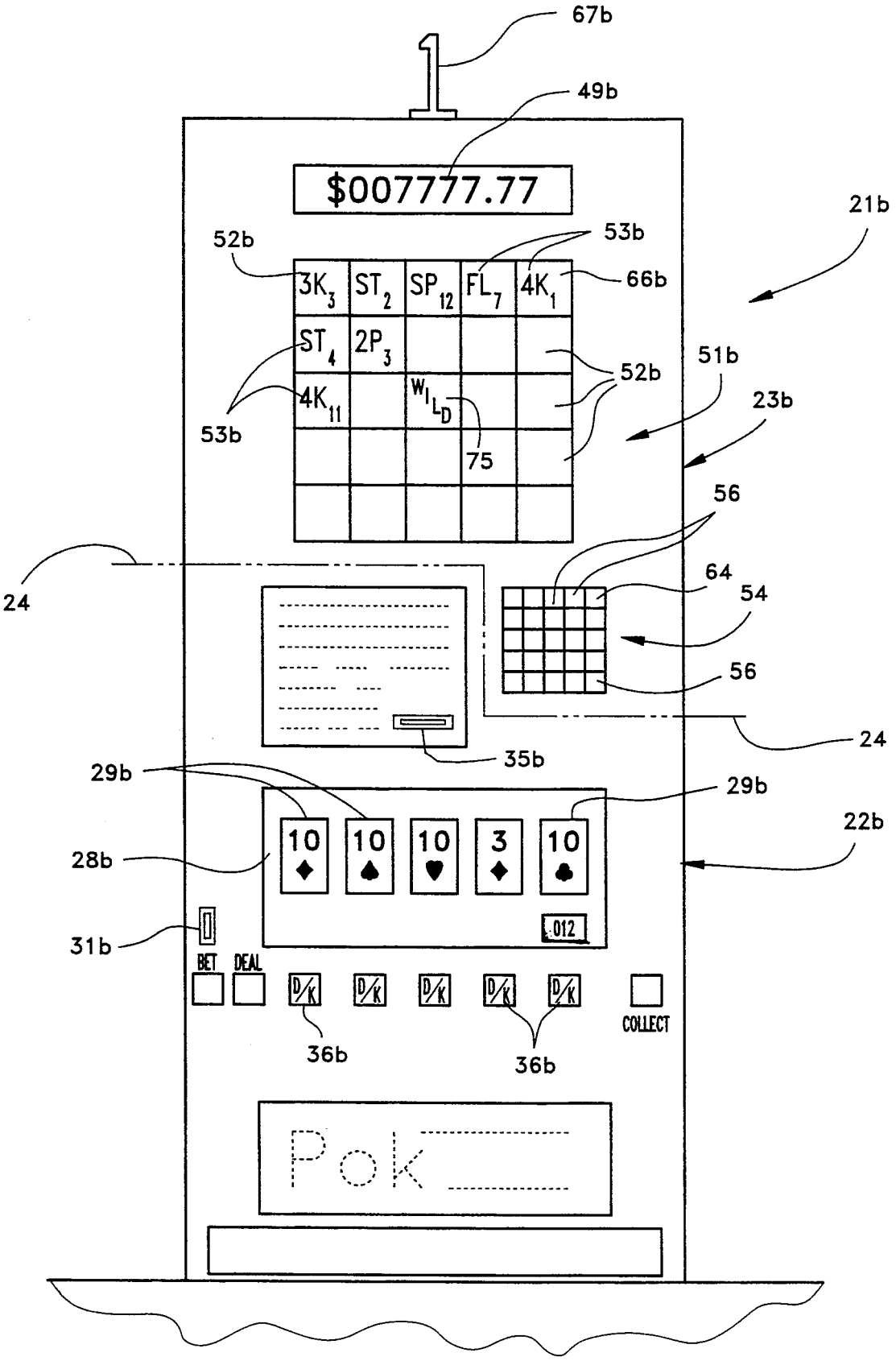
FIG. 3 is a front elevation view of a schematic representation of a further alternative embodiment of the electronic gaming apparatus of FIG. 1 including a user controlled input assembly for the bingo gaming apparatus.

When a secondary electronic gaming device is a bingo-type device it typically will include a bingo display assembly 51, which can be a video display with an associated indicia image generator, or it can be provided by other display means capable of providing a bingo matrix of spaces 52 in which indicia 53 can be displayed. As used herein, "bingo" and "bingo-type" shall include game simulations which are based upon, connected with, or derived from, a conventional bingo game. In fact bingo-type game apparatus **23*b* of FIG. 3 is not used to play a conventional bingo game. As set forth herein below, game apparatus 21*b* of FIG. 3 enables the player to select the space 52*b* in common bingo matrix 51*b*** into which input is made, rather than the conventional approach of the players following a master input.

Having described the basic poker and bingo gaming device components, play of the electronic gaming apparatus can be described. First, if gaming apparatus 21 is a stand-alone machine unconnected to other similarly formed game apparatus, the play proceeds by the player inputting one or more coins or tokens or a game card having token credits thereon. Game apparatus 21 optionally can include input criteria which must be met before the player can play the bingo game. Thus, if one or two coins are bet, the player would not be eligible for play of bingo apparatus 23, and if three or more coins are bet access to the bingo apparatus would be possible, as long as predetermined poker hands were drawn during play of the poker game.

Once the predetermined coin or credit input is made, the microprocessor and image generator will fill spaces 52 in bingo matrix 51 with indicia 53 representing randomly selected winning poker hands which are randomly distributed throughout matrix 51. This occurs automatically and outside the control of the player, and in the preferred form no two indicia 53 are identical. It will be understood, however, that duplicate indicia could be provided and a random computer selection or user selection also could be made as between duplicates.

Once the bingo screen spaces are filled, the player plays the electronic poker gaming apparatus in a conventional manner. If the player is able to "draw" a poker hand meeting the poker game criteria for a winning hand, the occurrence of such a winning hand either enables or automatically produces an entry into bingo matrix 51, if the bingo matrix also includes the winning hand.

Thus, in FIG. 1, the player has drawn three queens, which would normally be regarded as a winning hand in most poker gaming apparatus. Bingo space 66 had displayed indicia for three queens, and thus, the microprocessor substitutes in or displays over the three queens' indicia, the number of the poker gaming machine, in this case the number 7, as seen on tower light 67.

In a game apparatus which is not coupled to play a common bingo apparatus 23 with a plurality of players, the microprocessor can merely light, change the color or otherwise visually indicate that three queens was drawn.

When a winning poker hand is drawn, poker gaming apparatus 22 will pay or credit the player for such hand, whether or not it is present in matrix 51, or has already been drawn by the same or another player.

The player may continue to play poker gaming apparatus 22 until a BINGO is achieved in bingo gaming apparatus 23, at which point game apparatus 21 will award money, awards or benefits for winning the bingo game according to bingo criteria described in more detail below. Once the bingo game has been won and the player or players rewarded for winning, the bingo matrix screen will be cleared and a new random set of bingo indicia will be generated when the player or players again input the poker gaming apparatus.

Figure 2:
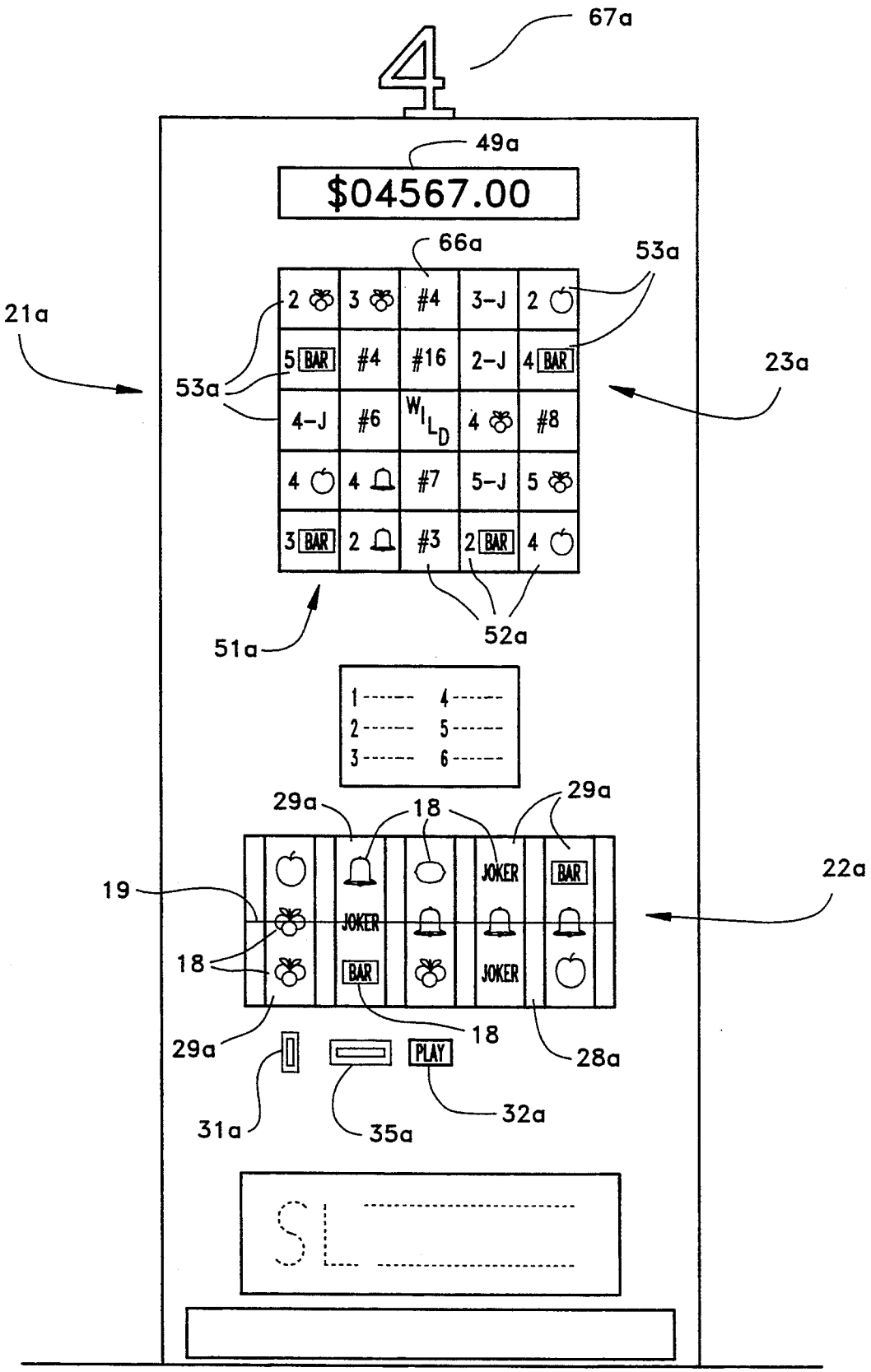
FIG. 2 is a front elevation view of a schematic representation of an alternative embodiment of the electronic gaming apparatus of FIG. 1 suitable for play of a slot machine game and a bingo game.

The play of the slot machine-bingo gaming apparatus **21*a* of FIG. 2 proceeds in a manner similar to the play of the gaming apparatus of FIG. 1. The primary gaming apparatus 22*a* of FIG. 2 is an electronic slot machine. Thus, video display screen 28*a* displays the images of a plurality of slot machine reels 29*a*, which can be "spun" or "rotated" by an image generator driven by a microprocessor. One or more alignment lines 19 can extend transversely across screen 28*a* to indicate the combination of images 18 which are to be compared against the schedule of slot machine winning criteria stored in the microprocessor memory. As shown in FIG. 2, three bells, a Joker and one cherries' image are aligned beneath payout line 19**. In most slot machines, this would meet the criteria for a payment.

The player, therefore, inserts a coin or coins in slot **31*a*, or a card into card reader slot 35*a*. After a predetermined input, the plurality of spaces 52*a* in bingo matrix 51*a* are filled by the microprocessor and an image generator with a random selection of slot machine indicia 53*a*. The player then hits the "play" button 32*a* or pulls the slot machine arm (not shown). The microprocessor will create a visual image of reels 29*a* spinning and usually stops the reels one-by-one starting at one end and proceeding to the other end of screen 28*a*. The reel images 18 can be virtually any image but usually are images of the type conventionally used on slot machines. The number of reels 29*a*** also can be varied within the scope of the present invention.

If the set of images 18 aligned under payout line 19 meets the slot machine payout criteria, the player wins an award, money or benefit ascribed to the set of images which have occurred. Additionally, since slot machine gaming apparatus **22*a* is electrically coupled to bingo gaming apparatus 23*a*, game apparatus 21*a* also enters the winning set of slot machine criteria into matrix 51*a*, if the matrix includes the same reel combination and if the reel combination has not been previously selected. In FIG. 2, space 66*a* has had the indicia "#4" entered therein. As seen from light tower 67*a*, machine 21*a* is the number 4 machine in a plurality of machines playing a common bingo game apparatus 23***a*. Space 66*a* previously had displayed symbols indicating three bells, and upon occurrence of this combination in machine number 4, the space is automatically identified as a space which contained a reel sequence occurring first on machine number 4.

As can be seen in matrix 51*a*, the occurrence of three bells completes a vertical line through the center "wild" space and constitutes a "bingo". Each identified machine on the bingo vertical line, namely machines 4, 16, 7 and 3 will participate in the payout or other award given as a result of completing the bingo game. Once the bingo awards are distributed, the bingo screen is cleared and a new bingo game can be started.

Figure 4:
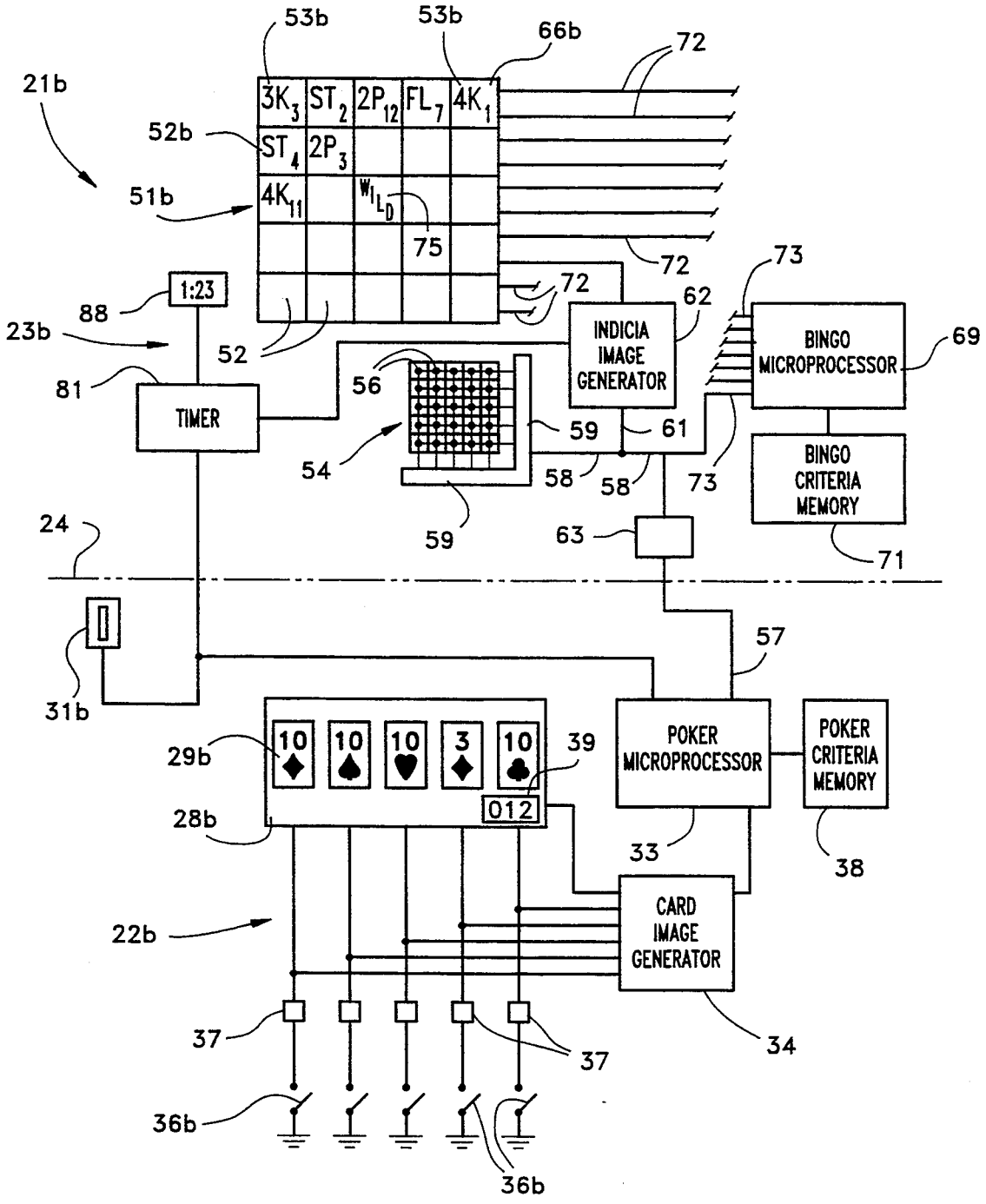
FIG. 4 is a schematic representation of the circuitry of the electronic gaming apparatus of FIG. 3.

An additional alternative embodiment of the game apparatus can be seen in FIG. 3, and a corresponding schematic representation for FIG. 3 game apparatus 21*b* is shown in FIG. 4. The schematic of FIG. 4 also will be seen to have applicability to the gaming apparatus of FIGS. 1 and 2. Electronic gaming apparatus 21*b* again is illustrated as including a poker gaming apparatus 22*b* as the primary gaming device. It will be understood that a slot machine or other game also could be used, as above described. In FIGS. 3 and 4, broken line 24 indicates approximately the boundary between the primary and secondary gaming apparatus.

Bingo-type game device 23*b* further preferably includes space selection means for selection of spaces 52*b* in bingo display matrix 51 for input of indicia 53*b*. In the preferred form, space selection means is provided by user-actuatable input means, generally designated 54, which is here shown as a keypad having an array of touch buttons 56. It will be appreciated, however, that display screen 51*b* could also be a touch screen with capacitive sensors or be actuated by a light pen, or a similar user-actuatable input device.

Since the preferred form of apparatus 21*b* is designed to be coupled to other similarly formed apparatus to enable the players to use strategy in playing against each other in a common bingo-type game, it is preferred that input means 54 for selection of spaces 52*b* be user-actuatable. It will be understood, however, that in a stand-alone game apparatus, individual spaces 52*b* in bingo display matrix 51*b* also could be selected at random, in advance, by an automatic space selection means in game apparatus 21*b*. In such a stand-alone game apparatus, a randomly preselected space might be identified by a blinking light, and the user would employ the strategy option of either inputting to the preselected space or declining to input to the space, depending what poker hand has occurred in poker gaming device 22*b*. In the preferred form, however, the player can touch any one of input buttons 56 to select a corresponding space 52*b* in display 51*b* for input to the matrix of spaces in bingo-type gaming device 23*b*. It will be understood that matrix 51*b* can have a greater or lesser number of spaces 52*b* and can have various arrays of spaces 52*b* which will vary the bingo-type game which is played.

In order to enable play of electronic bingo-type gaming device 23*b*, the bingo-type gaming device is electronically coupled to the primary gaming device 22*b*. As can be seen in FIG. 4, microprocessor 33 for the poker gaming apparatus is electrically connected by conductor means 57, which in turn, is connected by conductor means 58 to X,Y position logic 59 and by conductor means 73 to microprocessor means 69. X,Y position logic 59, in turn, is electrically connected to the keypad assembly 54 for user input. Conductor means 61 couples keypad 54, and input from the poker game apparatus 22*b*, to indicia image generator means 62. Finally, in multiple game machine carousel systems a station code identifying generator means 63 is provided to indicate which of apparatus $\mathbf{21}_1$–$\mathbf{21}_{16}$ is inputting bingo display 51*b*.

As also may be seen in FIG. 4, discard and keep buttons or switch 36*b*, are coupled through switch logic, represented in FIG. 4 by boxes 37. It will also be appreciated that switches 36, image generator 34 and screen 28*b* can be parallel or series coupled (multiplexed) or coupled with a combination of series and parallel circuits.

The player plays poker gaming apparatus in a manner identical to that described in connection with FIG. 1. Thus, a coin or token inserted in slot 31*b* or card inserted into card reader 35*b* will start the poker game. In game apparatus 21*b*, however, bingo matrix 51*b* and spaces 52*b* remain blank or are not filled with indicia 53*b*. Wild space 75, however, will be automatically positioned in matrix 51*b*, if a "wild" space is to be included in the bingo game.

If the player is able to draw one of the predetermined poker hands, poker gaming apparatus 22*b*, and more particularly microprocessor means 33 (FIG. 4), will send a signal to bingo microprocessor means 69 (FIG. 4) activating a keypad 54 for the selection of one space 52*b* in bingo matrix 51*b*. The player then touches a desired button 56*b*, and the selected space, for example, space 66*b* and corresponding memory in microprocessor means 69 are input with indicia generated electronically by indicia image generator 62.

The input of indicia into matrix 51*b* preferably is accomplished by inputting into the space 52*b* indicia which corresponds or is proportional in value to the hand occurring in poker gaming apparatus 22*b*. Thus, as can be seen in FIGS. 3 and 4, a four-of-a-kind, namely, four indicia 29*b* indicating tens, have occurred in poker gaming apparatus 22*b*, and the player has touched keypad button 64 to input in this case "4K*1*" in space 66. The indicia 4K stands for four-of-a-kind, and the subscript 1 is generated by station code identification means 63 when multiple machines are linked together to play a common bingo game. The subscript indicates station 1, which also may be identified by the machine number and tower light 67 on top of the game apparatus.

Thus, stored in poker criteria memory 38 will be a plurality of poker hands which not only produce a payout to the individual playing the poker gaming apparatus, but also produce a signal from microprocessor 33 enabling the bingo keypad 54. A typical schedule of winning hands might be as follows:

Royal Flush (RF)
Straight Flush (SF)
Four-of-a-Kind (4K)
Full House (FH)
Flush (FL)
Straight (ST)
Three-of-a-Kind (3K)
Two Pair (2P)

As will be appreciated, other hands can be included, such as, a pair of jacks or better and five-of-a-kind, if wild cards are provided.

Unlike conventional bingo games, however, electronic bingo-type apparatus 23*b* is formed to allow the player to try to fill in a predetermined pattern of spaces that will win the bingo game. Thus, bingo game winning criteria are stored in memory portion 71 of microprocessor means 69, as can be rules for determining valid input to matrix 51*b*. Thus, a player who draws one of the predetermined poker hands can select one space 52*b* in bingo matrix 51*b* for input toward the goal of completing a predetermined bingo pattern.

In the preferred form, bingo criteria storage means 71 includes rules as to permissible input to spaces 51*b*. For example, and particularly when gaming apparatus 21*b* is a stand-alone machine, it may be desirable to prevent duplication of the input in a single row or bingo winning pattern. Microprocessor means 69 and memory 71, therefore, can be programmed to prevent the entry of three-of-a-kind more than once in a potentially winning pattern. If the player attempts to make a second entry of three-of-a-kind in the same row or column, the input will be blocked and the player signaled to select another space, for example, by refusing input and blinking a light at or behind keypad 54.

While it is possible to allow an input to each bingo space 52*b* which merely fills the space without weighting in any manner the input to the space, it is preferred to enable input to bingo spaces 52*b* which are weighted or have a value which corresponds or is proportional to the value of the poker hand occurring in the poker gaming device. Thus, four-of-a-kind will be weighted more heavily in the bingo game than would two pair. Moreover, the effect of weighting of the various hands which can be input can be stored in memory 71 and microprocessor 69 used to compare the stored inputs in the various bingo matrix spaces which produce a winning pattern against the weighting stored in bingo criteria memory 71. Various conventional winning bingo patterns can be provided for, such as five in a row, either vertically or horizontally, plus five in a row diagonally, with or without a wild space 75. It should be noted that bingo microprocessor 69 optionally can randomly select the location of and whether or not there is a "wild" space 75. Additionally, winning the bingo game by filling a four corners or other patterns can be an option.

It will be understood that in a stand-alone gaming apparatus the microprocessor means 33 and 69, and poker criteria memory 38 and bingo criteria memory 71 can be provided by a single microprocessor. Moreover, station code generator 63 is not required in stand-alone machines, and the indicia entries 53*b* to spaces 52*b* will not include subscripts.

In all three embodiments, it is preferred that a plurality of game apparatus are linked together for play of a common bingo game by a plurality of players. Each game apparatus $21_1$–$21_{16}$ (FIG. 5) will have input conductor means to common display assemblies, for example, a four screen display assembly 82 over carousel 40. Each player at machines $21_1$–$21_{16}$, therefore will be able to view the progress of the common, or simultaneously played, bingo game on one of game screens 83, 84, 85 and 86. Additionally, it is preferred that each game apparatus $21_1$–$21_{16}$ shall have its own bingo matrix display $51_1$ to $51_{16}$, although screens 83–86 could be provided instead of display 51 at each machine. Conductor means 72 (FIG. 4) shall be understood, therefore, to couple each bingo game device to its own screen 51, 51*a*, 51*b* and any display assembly of screens 82.

When a plurality of gaming apparatus 21, 21*a*, 21*b* are linked together, a master bingo microprocessor 69 also preferably is employed, and each of apparatus $21_1$ to $21_{16}$ is connected to the master bingo microprocessor 69 by conductor means 73. Finally, for the game apparatus 21*b* in which spaces 52*b* are filled in by user selection, each individual gaming apparatus 21 will preferably have its own keypad 54 so that input to the commonly played bingo game, and identification of that input will require station or machine code generator means 63.

Upon play of the bingo game by multiple players, and upon the occurrence of filling of spaces 52, 52*a*, 52*b* in matrix 51, 51*a*, 51*b* which meets the bingo criteria of memory 71, the bingo game will be deemed to be complete. Bingo microprocessor 69 can weight the proportion of the amount to be paid out, for example, progressive jackpot number 49, 49*a*, 49*b*, among the weighted input in the winning bingo row. Thus, in the "bingo" of FIG. 3, station one, with four-of-a-kind, would receive a greater proportion of the progressive bingo jackpot than would station 12, which had input two pair. The bingo master microprocessor 69 would then provide a signal back to the individual machines, namely, machines $21_1$, $21_2$, $21_3$, $21_7$ and $21_{12}$, indicating the amount of money, or other award, that each player had won. Master bingo microprocessor 69 would then clear the winning row or possibly the entire bingo matrix.

Optionally, it is also possible to provide timing means 81 (FIG. 4) electrically connected to the poker input device, such as coin slot 31, 31*a*, 31*b* and electrically connected to bingo game apparatus 23, 23*a*, 23*b* so as to place a time constraint on input from individual machines to bingo matrix 51, 51*a*, 51*b*. Timer 81 can be used, for example, to start a bingo game of finite duration which all participating machines play. The time might start upon the first to place a coin in one of the coin receptacles, and the bingo game would have to be won within a fixed period of time. At the end of the time period, matrix 51, 51*a*, 51*b* would be wiped clean. A countdown display 88 (FIG. 4) could be provided in this option.

In a similar option, timing means 81 could sense input at coin slot 31, 31*a*, 31*b* and/or bet button 43 and maintain the input in bingo matrix 51, 51*a*, 51*b* for so long as there is activity at a particular machine. Thus, if a machine is not played for some predetermined period of time, for example 5 minutes, the entries from that machine may fall out or be expunged from the bingo matrix. In a similar manner, user input means optionally could be provided so that a user leaving his machine could remove his entries from the bingo matrix so that subsequent players of the same machine did not obtain the benefit of these entries. This option, however, also changes the position and strategy of other players when machines are linked together, and it is most applicable to stand-alone machines.

It is possible in both stand-alone and carousel systems that a player will be unable to make a valid entry in the bingo matrix because of prior entries and the nature of the poker hand which occurs. Two pairs, for example, will occur sufficiently often that the possible spaces for valid input may be filled. In such a case the bingo microprocessor 69 will refuse entry, deactivate or refuse to activate keypad 54, and signal the player that the poker hand which occurred cannot be entered in matrix 51*b*. For automatic entry apparatus such as gaming apparatus 21 and 21*a*, the primary payout will be made but no entry into the bingo matrix will occur.

As will be apparent from the above description of the apparatus of the present invention, the method of playing an electronic game apparatus of the present invention is comprised of the steps of playing a primary game, such as a poker or slot machine game, on an electronic primary gaming device, such as a poker or slot machine gaming device, and upon the occurrence of selected events, such as selected poker hands or reel combinations, playing a secondary game, such as a bingo-type game, on an electronic secondary gaming device, such as a bingo-type gaming device. The secondary gaming device is electrically connected to the primary gaming device, with the playing of the secondary game being accomplished, for example, automatically or by user input to select a single space in a bingo matrix for each poker hand which occurs. Preferably the input corresponds to the poker hand or reel combination which has occurred in the poker gaming device or slot machine.

The electronic gaming apparatus of the present invention can be formed using electronic components that are conventional and in widespread use in such gaming apparatus. There are many combinations of components which will be satisfactory to produce the game apparatus of the present invention, and one skilled in the art of logic and circuit design can readily make a selection of the same to implement the gaming apparatus as described herein.

What is claimed is:

1. An electronic gaming apparatus comprising:

an electronic primary gaming device having primary user-actuatable input means for play of a primary game; and an electronic secondary gaming device for play of a secondary game;

said primary gaming device being coupled to said secondary gaming device and being responsive to the occurrence of at least one predetermined, winning event in the play of said primary game to communicate an input signal to said secondary gaming device for play of said secondary game.

2. The electronic gaming apparatus as defined in claim 1 wherein, said input signal to said secondary gaming device effects play of said secondary gaming device.

3. The electronic gaming apparatus as defined in claim 2 wherein, said primary gaming device is one of an electronic poker gaming device and a slot machine; and said secondary gaming device is an electronic bingo-type gaming device.

4. The electronic gaming apparatus as defined in claim 1 wherein, said secondary gaming device is provided with user-actuatable input means for play of said secondary game; and said input signal activates said user-actuatable input means for user input to said secondary gaming device.

5. The electronic gaming apparatus as defined in claim 4 wherein, said secondary gaming device is responsive to each one of a plurality of predetermined, winning events during play of said primary game using said primary gaming device to activate said secondary user-actuatable input means for a single input to said secondary gaming device.

6. An electronic gaming apparatus comprising:

a plurality of electronic primary gaming devices, each having primary user-actuatable input means for play of a primary game; and an electronic secondary gaming device for play of a secondary game; wherein, each primary gaming device being electrically connected to said secondary gaming device, each being formed for independent play of said primary game, and each being responsive to the occurrence of at least one predetermined event in the play of said primary game to communicate an input signal to said secondary gaming device, each of said input signals to said secondary gaming device effecting play of said secondary gaming device; and said secondary gaming device being responsive to the occurrence of a predetermined event in any one of the primary gaming devices to input said secondary gaming device for play of said secondary game simultaneously by each user of said primary gaming devices.

7. The electronic gaming apparatus as defined in claim 6 wherein, each of the electronic primary gaming devices are electronic poker gaming devices; and said secondary gaming device is an electronic bingo-type gaming device.

8. The electronic gaming apparatus as defined in claim 6 wherein, each of the electronic primary gaming devices are electronic slot machines; and said secondary gaming device is an electronic bingo type gaming device.

9. An electronic gaming apparatus comprising:

an electronic primary gaming device including display means and user-actuatable input means for play of a primary game; and an electronic bingo-type gaming device including bingo display means having a plurality of spaces in a bingo matrix for play of a bingo-type game; and said primary gaming device being electrically connected to said bingo-type gaming device, and said primary gaming device communicating a signal to said bingo-type gaming device for input to said bingo matrix upon the occurrence of selected, winning events in said primary gaming device.

10. The electronic gaming apparatus as defined in claim 9 wherein, said primary gaming device is one of an electronic poker gaming device and an electronic slot machine.

11. The electronic gaming apparatus as defined in claim 9 wherein, said primary gaming device is an electronic slot machine which communicates said signal to said bingo-type gaming device upon the occurrence of selected, winning reel combinations in said slot machine.

12. The electronic gaming apparatus as defined in claim 11 wherein, said bingo-type gaming device includes bingo indicia generating means producing a distribution of bingo indicia related to said selected, winning reel combinations in said plurality of spaces in said bingo matrix at a time prior to receipt of said signal from said slot machine.

13. An electronic gaming apparatus comprising:

an electronic primary gaming device including display means and user-actuatable input means for play of a primary game; and an electronic bingo-type gaming device including bingo display means having a plurality of spaces in a bingo matrix for play of a bingo-type game, said primary gaming device being electrically connected to said bingo-type gaming device, and said primary gaming device communicating a signal to said bingo-type gaming device for input to said bingo matrix upon the occurrence of selected events in said primary gaming device, wherein said primary gaming device is a poker gaming device which communicates said signal to said bingo-type gaming device upon the occurrence of selected poker hands.

14. The electronic gaming apparatus as defined in claim 13 wherein, said bingo-type gaming device includes bingo indicia generating means producing a distribution of bingo indicia related to said selected poker hands in said plurality of spaces in said bingo matrix at a time prior to receipt of said signal from said poker gaming device.

15. The electronic gaming apparatus as defined in claim 14 wherein, said bingo indicia generating means substantially fills all of said spaces in said bingo matrix with said bingo indicia and randomly distributes said bingo indicia in said spaces.

16. The electronic gaming apparatus as defined in claim 15 wherein, said bingo-type gaming device is responsive to said signal to automatically select a space in said matrix corresponding to the selected poker hand occurring in said poker gaming device if a corresponding indicia is present in said matrix and has not previously been selected.

17. An electronic gaming apparatus comprising:

an electronic primary gaming device including display means and user-actuable input means for play of a primary game; and an electronic bingo-type gaming device including bingo display means having a plurality of spaces in a bingo matrix for play of a bingo-type game, said primary gaming device being electrically connected to said bingo-type gaming device, and said primary gaming device communicating a signal to said bingo-type gaming device for input to said bingo matrix upon the occurrence of selected events in said primary gaming device wherein, said primary gaming device is an electronic slot machine which communicates said signal to said bingo-type gaming device upon the occurrence of selected reel combinations in said slot machine, said bingo-type gaming device includes bingo indicia generating means producing a distribution of bingo indicia related to said selected reel combinations in said plurality of spaces in said bingo matrix at a time prior to receipt of said signal from said slot machine, and wherein said bingo indicia generating means substantially fills all of said spaces in said bingo matrix with said bingo indicia and randomly distributes said bingo indicia in said spaces.

18. The electronic gaming apparatus as defined in claim 17 wherein, said bingo-type gaming device is responsive to said signal to automatically select a space in said matrix corresponding to the selected reel combinations occurring in said slot machine if a corresponding indicia is present in said matrix and has not previously been selected.

19. An electronic gaming apparatus comprising:

an electronic primary gaming device including display means and user-actuable input means for play of a primary game; and an electronic bingo-type gaming device including bingo display means having a plurality of spaces in a bingo matrix for play of a bingo-type game, said primary gaming device being electrically connected to said bingo-type gaming device, and said primary gaming device communicating a signal to said bingo-type gaming device for input to said bingo matrix upon the occurrence of selected events in said primary gaming device, wherein said bingo gaming device includes user-actuable bingo space selection means connected to enable user selection of the space in said bingo matrix to receive input.

20. The electronic gaming apparatus as defined in claim 19 wherein, said selected events occurring in said primary gaming device have differing values; and said input to the selected space in said bingo-type gaming device has a value corresponding to the value of the occurring event.

21. An electronic gaming apparatus comprising:

an electronic primary gaming device including display means and user-actuable input means for play of a primary game; and an electronic bingo-type gaming device including bingo display means having a plurality of spaces in a bingo matrix for play of a bingo-type game said primary gaming device being electrically connected to said bingo-type gaming device, and said primary gaming device communicating a signal to said bingo-type gaming device for input to said bingo matrix upon the occurrence of selected events in said primary gaming device, and further comprising:

a plurality of additional primary gaming devices each having display means, user-actuable primary input means for play of a primary game, and criteria means responsive to the occurrence of selected events to produce an input signal;

said additional electronic primary gaming devices each being electrically connected to said bingo-type gaming apparatus for communication of input signals to said bingo-type gaming device on the occurrence of said selected events;

said bingo-type gaming apparatus being responsive to receipt of an input signal from said additional electronic primary gaming devices to input said bingo matrix; and identification means electrically connected for correlating the identity of ones of said primary gaming device communicating input signals to said bingo-type gaming device during play of said bingo-type game.

22. The electronic gaming apparatus as defined in claim 21, and said bingo-type gaming device including bingo criteria means responsive to a predetermined pattern of input to said spaces to determine the occurrence of winning of said bingo-type game; and bingo payout means electrically connected to said bingo criteria means and responsive to the occurrence of said predetermined pattern to payout of awards to the primary gaming devices identified by said identification means as having input into spaces producing the winning pattern.

23. An electronic gaming assembly comprising:

a plurality of electronic poker gaming devices each formed for independent play of a simulated poker game and each having user-actuatable poker input means electrically connected to enable users to play said poker game;

an electronic bingo-type gaming device formed for play of a simulated bingo-type game and including bingo display means having a bingo matrix of a plurality of spaces; and each of said plurality of electronic poker gaming devices further being electrically connected to said bingo-type gaming apparatus, each of said poker gaming devices producing a selection of previously unselected bingo spaces corresponding to and upon the occurrence of selected poker hands in said poker gaming devices to permit the user of the poker gaming device to play said bingo-type gaming device.

24. The electronic gaming assembly as defined in claim 23 wherein, said bingo display means includes a plurality of bingo displays with one bingo display located at each of said poker gaming devices, said plurality of bingo displays each displaying the combined input to said bingo-type gaming device at each of said poker gaming devices.

25. The electronic gaming apparatus as defined in claim 24, and bingo criteria means electrically connected to said bingo-type gaming device and to said poker gaming devices and formed to determine when said bingo-type game is won and formed to produce signals attributing winning benefits to poker gaming devices having input into the spaces meeting the criteria for winning of said bingo-type game.

26. The electronic gaming apparatus as defined in claim 25, and payout means electrically connected to payout awards at selected poker gaming devices in response to said signals attributing winning benefits to said poker gaming devices.

27. A method of playing an electronic game comprising the steps of:

playing a primary game on a primary electronic gaming device by user input through primary input means; and upon the occurrence of predetermined, winning events in said primary electronic game device, playing a secondary game on a secondary electronic gaming device electrically connected to said primary electronic gaming device by making an input to said secondary electronic gaming device upon said occurrence of predetermined, winning events in primary electronic game device.

28. The method of playing an electronic game as defined in claim 27 wherein, said step of playing a primary game is accomplished by playing one of a poker game and a slot machine on said primary gaming device.

29. The method of playing an electronic game as defined in claim 28 wherein, said step of playing said primary game is accomplished by playing a slot machine game.

30. The method of playing an electronic game as defined in claim 27 wherein, said step of playing a secondary game is accomplished by playing a bingo-type game on an electronic bingo-type gaming device.

31. The method of playing an electronic game as defined in claim 27 wherein, said step of making an input is accomplished by user inputting to said secondary gaming device an input which is proportional to the value of a winning event occurring in said primary gaming device.

32. A method of playing an electronic game comprising the steps of:

playing a primary game on a primary electronic gaming device by user input through primary input means; and upon the occurrence of predetermined events in said primary electronic game device playing a secondary game on a secondary electronic gaming device electrically connected to said primary electronic gaming device by making an input to said secondary electronic gaming device upon said occurrence of predetermined events in primary electronic game device, wherein said step of playing a primary game is accomplished by playing a poker game.

33. A method of playing an electronic game comprising the steps of:

playing a primary game on a primary electronic gaming device by user input through primary input means; and upon the occurrence of predetermined events in said primary electronic game device, playing a secondary game on a secondary electronic gaming device electrically connected to said primary electronic gaming device by making an input to said secondary electronic gaming device upon said occurrence of predetermined events in primary electronic game device, wherein there are a plurality of independent primary gaming devices each electrically connected to a common secondary gaming device, and during said playing step, a plurality of players each play a primary game on said plurality of independent primary gaming devices; and upon occurrence of a selected events at any one of said independent primary gaming devices, playing said secondary game by inputting into said secondary gaming device from the one of a predetermined number of primary gaming devices at which one of said selected events occurred.

* * * * *